US008616805B2

(12) United States Patent
Hawkes et al.

(10) Patent No.: US 8,616,805 B2
(45) Date of Patent: Dec. 31, 2013

(54) OPTICAL FIBER MANAGEMENT SYSTEM AND METHOD

(75) Inventors: Graham Hawkes, San Anselmo, CA (US); Charles S Chiau, Milpitas, CA (US); Adam Wright, San Anselmo, CA (US)

(73) Assignee: Bluefin Robotics, Corporation, Quincy, MA (US)

( * ) Notice: Subject to any disclaimer, the term of this patent is extended or adjusted under 35 U.S.C. 154(b) by 98 days.

(21) Appl. No.: 13/110,726

(22) Filed: May 18, 2011

(65) Prior Publication Data

US 2011/0283930 A1 Nov. 24, 2011

Related U.S. Application Data

(63) Continuation-in-part of application No. 12/793,589, filed on Jun. 3, 2010, and a continuation-in-part of application No. 12/795,971, filed on Jun. 8, 2010, now Pat. No. 8,369,673.

(60) Provisional application No. 61/345,985, filed on May 18, 2010.

(51) Int. Cl.
*F16L 1/12* (2006.01)

(52) U.S. Cl.
USPC ..... 405/158; 405/154.1; 405/168.3; 405/190; 405/191

(58) Field of Classification Search
USPC ..... 405/154.1, 158, 168.1, 168.3, 168.4, 405/165, 190, 191; 114/312, 322, 328
See application file for complete search history.

(56) References Cited

U.S. PATENT DOCUMENTS

| | | | | |
|---|---|---|---|---|
| 2,987,893 | A * | 6/1961 | Robinson, Jr. | 405/191 |
| 4,696,438 | A * | 9/1987 | Myers | 242/118.41 |
| 4,909,589 | A * | 3/1990 | Morris | 385/25 |
| 5,722,793 | A * | 3/1998 | Peterson | 405/164 |
| 6,167,831 | B1 | 1/2001 | Watt et al. | 114/322 |
| 6,223,675 | B1 | 5/2001 | Watt et al. | 114/312 |
| 6,257,162 | B1 | 7/2001 | Watt et al. | 114/244 |
| 6,270,288 | B1 * | 8/2001 | Weidenheft et al. | 405/158 |
| 6,390,012 | B1 | 5/2002 | Watt et al. | 114/322 |

FOREIGN PATENT DOCUMENTS

JP 2009265251 * 11/2009

OTHER PUBLICATIONS

"International Search Report", mailed Aug. 13, 2012, PCT/US2012/038423.

* cited by examiner

*Primary Examiner* — Sean Andrish
(74) *Attorney, Agent, or Firm* — Paul K. Tomita

(57) ABSTRACT

An optical fiber management system for a remotely operated vehicle (ROV) includes a spool containing a length of optical cable, a motor coupled to the spool, a motor controller, a speed sensor and a feed mechanism. The motor controller can detect the speed of the ROV through water and control the rotational speed of the motor so that the optical cable is removed from the spool at a speed that is equal to or greater than the speed of the ROV. A feed mechanism is used to apply a tension to the optical cable so that it is removed from the spool and emitted from the ROV without becoming tangled.

20 Claims, 6 Drawing Sheets

103
103
103
109
102
109
102
109
102

OPTICAL FIBER MANAGEMENT SYSTEM AND METHOD

CROSS REFERENCE TO RELATED PATENT APPLICATIONS

This patent application claims priority to U.S. Provisional Patent Application No. 61/345,985, Optical Fiber Management System, filed May 18, 2010. This application is also a continuation in part of U.S. patent application Ser. No. 12/793,589, Deployable Optical Fiber Cartridge, filed Jun. 3, 2010 and U.S. patent application Ser. No. 12/795,971, Ocean Deployable Biodegradable Optical Fiber Cable, filed Jun. 8, 2010. The contents of U.S. patent application Ser. Nos. 12/793,589, 12/795,971 and 61/345,985 are hereby incorporated by reference.

FIELD OF INVENTION

The application is directed towards a system for deploying an optical fiber from an optical fiber cartridge in underwater applications.

BACKGROUND

Fibers such as optical fibers have been used in underwater applications to transmit and receive information. For example, an underwater device can have a propulsion system and a direction control mechanism. The underwater device can be deployed by a support ship and an optical fiber can be coupled between the underwater device and the support ship. The support ship can transmit control information to the underwater device that is used to operate the direction control mechanism.

In some underwater devices, an optical fiber can be under substantial tension due to the movement of the support ship, the underwater device, the water currents and contact with sea life and stationary objects. In order to withstand the tension forces without breaking, the optical fibers can be covered with a protective jacket that prevents the optical fiber from braking. However, this protective jacket adds substantial weight and volume to the optical fiber. What is needed is an improved system that prevents significant tension forces to be applied to the optical fiber so that a thin optical cable can be used without a protective jacket.

SUMMARY OF THE INVENTION

A thin cross section optical fiber that does not include a high strength jacket is stored on a spool stored in an optical fiber management system on a remotely operated vehicle (ROV). In a preferred embodiment, the optical fiber is biodegradable as disclosed by U.S. patent application Ser. No. 12/795,971, Ocean Deployable Biodegradable Optical Fiber Cable. The optical fiber can be wound on a pressure tolerant spool as disclosed by U.S. patent application Ser. No. 12/793,589, Deployable Optical Fiber Cartridge. As the ROV moves through the water, a sensor will detect the speed of the ROV and the optical fiber management system will rotate the spool and a feed system will pull the optical fiber from the spool at a rate that is approximately equal to or faster than the movement of the ROV through the water. By emitting the optical fiber from the ROV, the optical fiber is essentially stationary in the water and there is minimal tension applied to the fiber.

In another embodiment, a second optical fiber management system having a second spool of optical fiber can be mounted in a surface structure on or adjacent to a surface support ship. A sensor can detect the movement of the surface support ship and emit the optical fiber from the second spool at a rate that is approximately equal to or faster than the movement of the support ship through the water. As the ship moves, the optical fiber can be released from the second spool to minimize the tension in the fiber.

The optical fiber management system can include a motor that rotates the spool of optical cable, an optical fiber emitter that pulls the optical cable from the spool and a controller that controls the speed of the motor and the pulling speed of the optical cable emitter. The controller monitors the speed of the ROV or support ship and adjusts the rotational speed of the motor so the optical cable is emitted at the same or slightly faster rate.

In an embodiment, the optical fiber management system can be controlled by the control signals transmitted to the ROV. If the ROV receives a signal to move in any direction, the optical fiber management system can determine the speed of the control signal and emit the optical fiber at the same or slightly faster rate. In this embodiment, the optical fiber management system can respond more quickly because it can emit the optical fiber when the movement control signal is received. There will be some delay in the ROV's response, so the optical fiber management system can emit the optical cable just before the ROV moves.

The optical cable can be removed from the spool and fed to an emitter that applies a tension to the optical cable so that it is removed from the spool without tangling. The emitter can apply a tension force that can be less than about 1 pound of force. For example, in an embodiment the emitter can apply an optical cable tension of about ½ to 1 ounce which can gently pull the optical fiber from the spool as it rotates but may not cause the optical fiber spool to rotate faster than the motor rotation.

A communications device on the ROV can communicate with the support ship through the optical fiber on the spool, However, since the spool rotates, a rotational coupling can be attached to the optical fiber that allows signals to be transmitted as the optical cable rotates on the spool. An end of the optical fiber can be coupled to a rotational coupling which allows optical signals.

DETAILED DESCRIPTION

Figure 1:
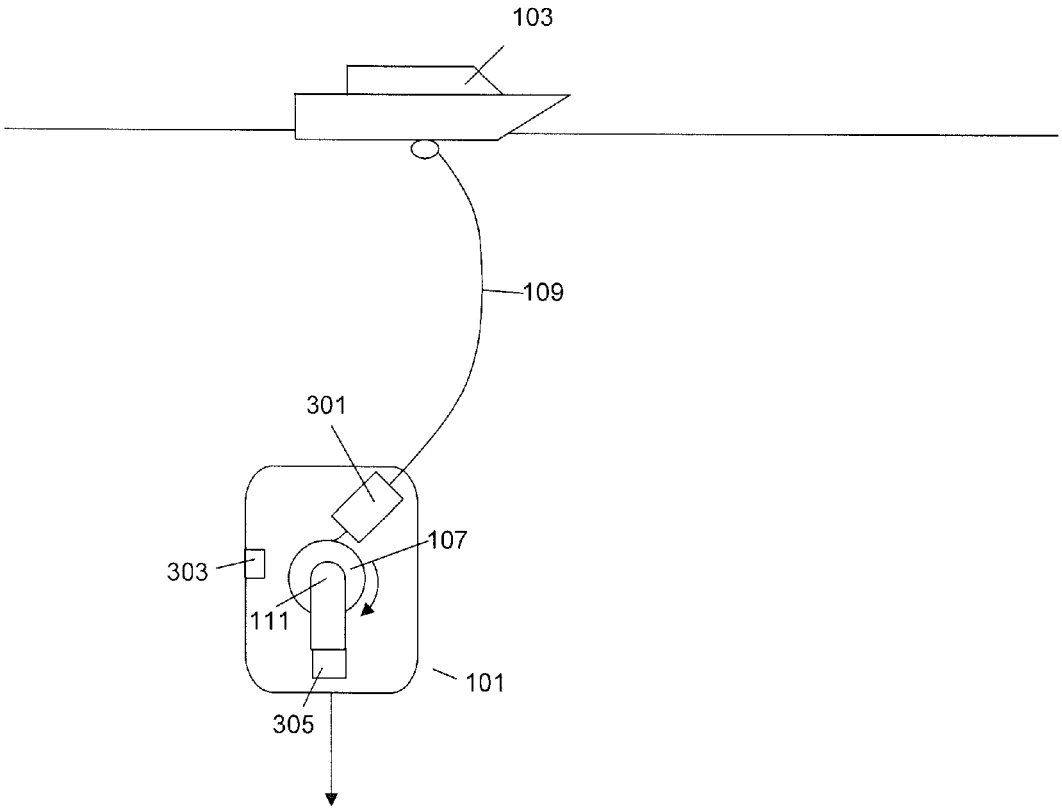
FIG. 1 illustrates an ROV having a spool storing an optical cable.

The present invention is directed towards a spool for storing a fiber for underwater applications. With reference to FIG.

1, in an embodiment, the fiber can be an optical fiber 109 that is stored on a spool 107 that is used for communications between a support ship 103 and a Remotely Operated Vehicle (ROV) 101. An end of the optical fiber 109 can be coupled to communications equipment on the support ship 103 and the other end of the optical fiber 109 can be coupled to communications and control equipment on the ROV 101.

The spool 107 of the optical fiber 109 is stored on the ROV 101. As the ROV 101 travels, the spool 107 can rotate which causes the optical fiber 109 to stream out of the ROV 101. The end of the optical fiber 109 can be coupled to a rotating coupling 111 so the spool 107 can rotate while maintaining communications between the ROV 101 and the support ship 103. In an embodiment, a sensor 303 can detect the relative velocity of the ROV 101 through the water and then control the rotational rate of the spool 107 to emit the optical fiber 109 at a rate that is substantially equal to or greater than the relative velocity of the ROV 101 through the water.

In another embodiment, a receiver 305 can detect control signals from the support ship 103. These control signals can include velocity signals that control the propulsion system of the ROV 101. The receiver 305 can detect the control velocity signal from the support ship 103 to the ROV 101 and then control the rotational rate of the spool 107 to emit the optical fiber 109 at a rate that is substantially equal to or greater than the control signal velocity of the ROV 101 through the water.

Figures 2A, 2B, 2C:
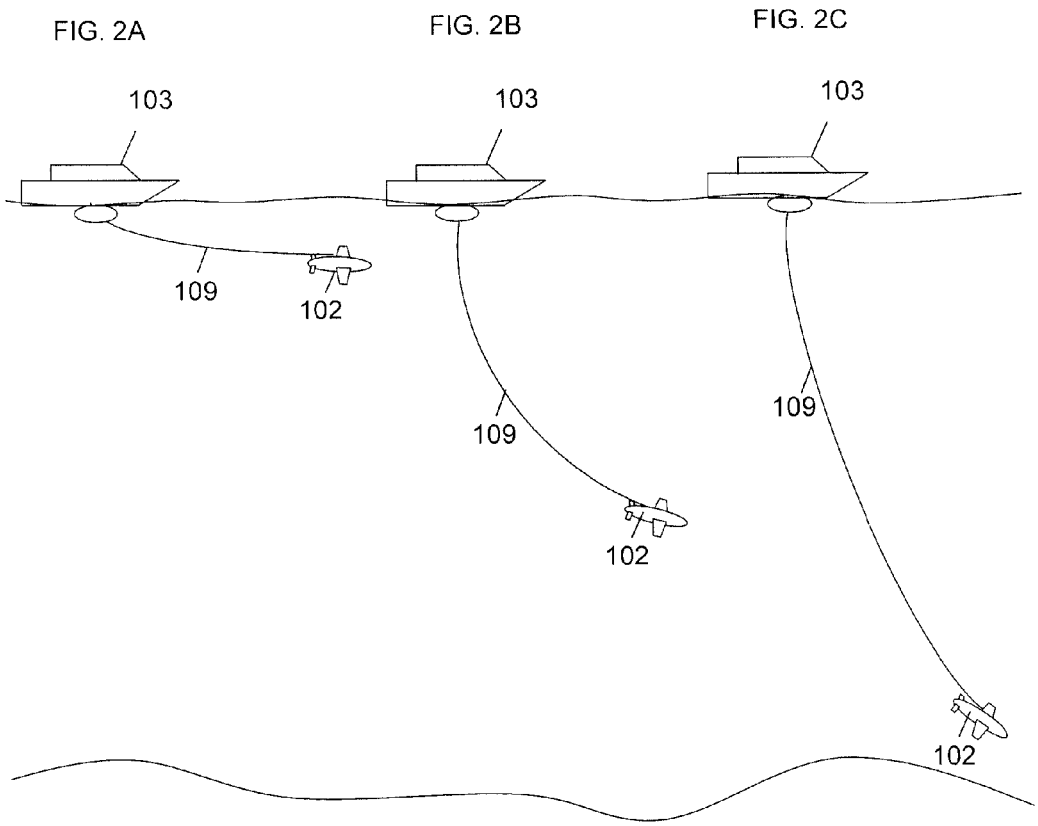
FIGS. 2A-2C illustrate a winged ROV coupled to a support ship by an optical cable.

With reference to FIG. 2, in an embodiment, the opposite ends of the optical fiber 109 can be wrapped around two separate spools or the system can use two optical fibers wound on two different spools that are connected. Each of the spools can be similar to the spool shown in FIG. 1. One spool can be mounted in a ROV 102 that travels away from a support ship 103 and a second spool can be mounted close to the surface and may be connected to a support ship 103. The ROV 102 can be a "winged submersible" that is described in U.S. Pat. No. 7,131,389 which is hereby incorporated by reference. As the ROV 102 travels away from the support ship 103, the optical fiber 109 is removed from the spool in the ROV 102. Similarly, as the support ship 103 moves through the water due to propulsion or current, the optical fiber 109 is removed from the second spool. Thus, the optical fiber 109 is not tensioned significantly even if the ROV 102 and the support ship 103 move.

Figure 3:
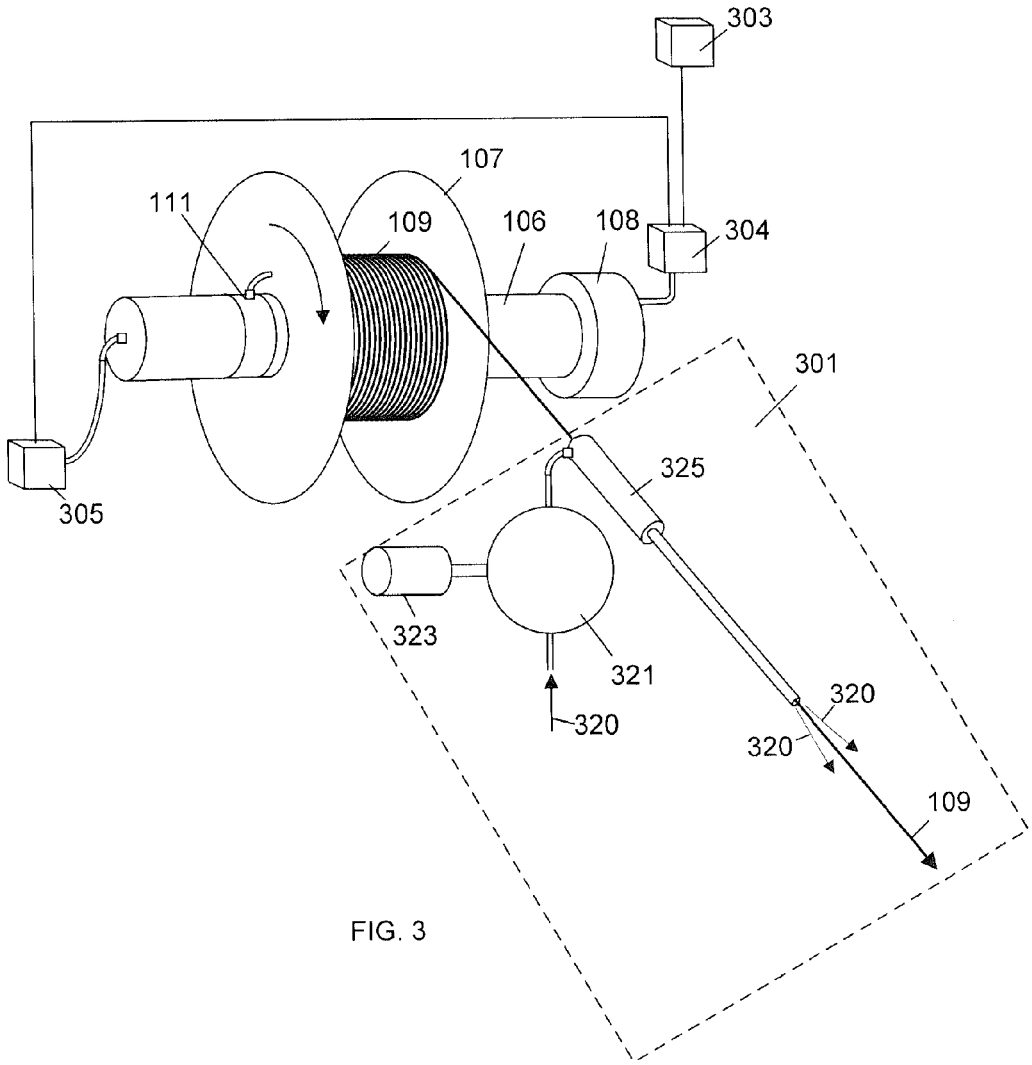
FIG. 3 illustrates an embodiment of a cable management system.

A more detailed illustration of an embodiment of an optical fiber management system is illustrated in FIG. 3. In this example, the optical fiber management system can include a rotating coupling 111, the spool 107, a motor 108 and an emitter mechanism 301. The spool 107 can be mounted on an axle 106 which is coupled to a motor 108 and allows the spool 107 to rotate. The motor 108 can be coupled to a controller 304 that controls the rotational velocity of the motor 108. The controller 304 can also be coupled to sensors that can indicate the speed of the ROV. For example, the controller 304 can be coupled to a velocity sensor 303 that detects the speed of the ROV 101 through the water. The velocity sensor 303 can be a speed transducer which can be a mechanical, ultrasonic or any other mechanism that detects the speed of the ROV through the water or other ambient fluid.

In another embodiment, the optical fiber management system may include a receiver 305 that is coupled to one end of the optical fiber 109. The receiver 305 can receive control signals from the support ship which control the speed of the ROV. In this embodiment, the receiver 305 can detect movement control signals and transmit the control signals to the controller 304. The controller can then predict the velocity of the ROV from these control signals and cause the motor 108 to rotate at the rate necessary to release the optical fiber 109 at a velocity that is equal to or greater than the predicted velocity of the ROV. In other embodiments, it is possible to have both the receiver 305 and the velocity sensor 303 coupled to the controller 304 and work in combination. Signals from the receiver 305 may indicate that the ROV is about to move and the controller 304 can cause the motor 108 to start rotating. Then, the velocity sensor 303 can transmit a velocity signal to the controller 304 so that the rate of optical fiber 109 movement corresponds to the actual velocity of the ROV.

The rotation of the motor can be based upon the equation, velocity of the optical cable=radius of the spool times the rotational velocity of the motor. Thus, if the spool is about 3.5 inches or 0.2917 feet, the circumference of the spool is 1.8326 feet. If the detected velocity of the ROV is 5 feet per second, the rotation of the motor must be greater than 5 feet per second/1.8326 feet, 2.728 rotations per second or 163.7 rotations per minute (RPM). In an embodiment, the ROV may travel at less than 10 feet per second and the corresponding rotational velocity may be greater than 327.4 RPM.

The optical fiber management system may also include an emitter mechanism 301 for removing the optical fiber 109 from the spool 107. If the spool 107 is only rotated by the motor 108, the optical fiber 109 can become tangled before it exits the ROV. In order for the optical fiber 109 to be removed from the ROV smoothly, the emitter mechanism 301 can maintain a constant tension on the optical fiber 109 regardless of the rotational velocity of the motor 108. In an embodiment, the emitter mechanism 301 can include a water pump 321, a water pump motor 323 and a feed tube 325. The motor 323 can actuate the water pump 321 which pumps water 320 through the feed tube 325. The water 320 can enter a front end of the feed tube 325 and exit the back end of the feed tube 325. The feed tube 325 can have a wider diameter front end and a thinner diameter back end. The optical fiber 109 is placed in the feed tube 325 and the velocity of the water 320 around the optical fiber 109 in the feed tube 325 pulls the optical cable 109 with a constant tension. In an embodiment, the optical fiber 109 can fit through a close fitting hole at the front end of the feed tube 325 and exit a wider hole at the back end of the feed tube 325. Because the back end of the feed tube 325 provides a path of least resistance, substantially all of the water pumped into the feed tube 325 will flow into the front end and out the back end. The narrowed diameter at the back end of the feed tube 325 will cause the water 320 flow rate to increase when it enters the back end of the feed tube 325. This increased velocity can increase the tension on the optical fiber 109. In other embodiments other types of emitter mechanisms can be used with the optical fiber management system.

The optical fiber 109 tension caused by the emitter mechanism 301 can maintain a tension of less than about 1 pound of force. In an embodiment, the tension on the optical fiber 109 can be about ½ to 1 ounce of force. This force can keep the portion of the optical fiber 109 between the spool 107 and the feed tube 325 taught but is not enough force to cause the spool 107 to rotate without the rotation of the motor 108. The back end of the feed tube 325 can be positioned outside the ROV and directed towards the rear of the ROV.

Figure 4:
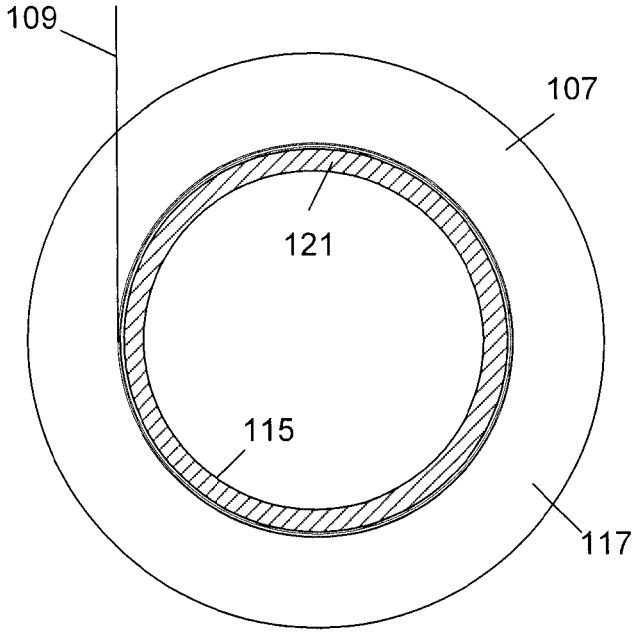
FIG. 4 illustrates a cross section view of a spool storing an optical cable.
Figure 5:
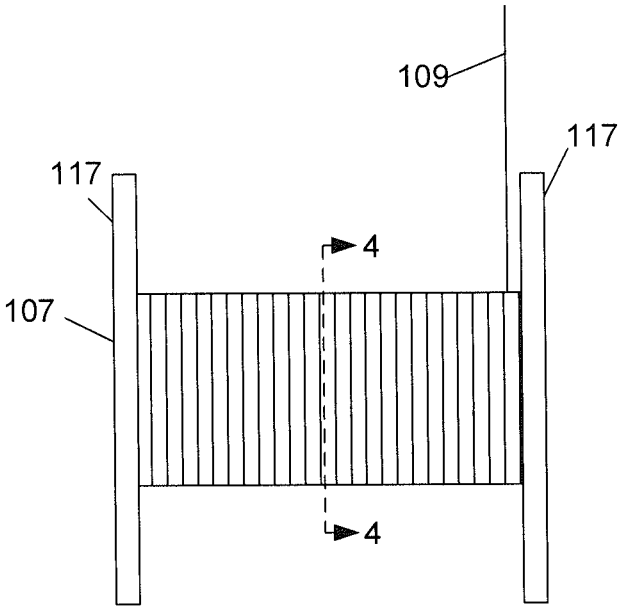
FIG. 5 illustrates a front view of a spool storing an optical cable.

In an embodiment, the spool 107 may include an open compressible cylindrical structure 121. FIG. 4 is a cross sectional view of the spool 107 and FIG. 5 is a front view of the spool 107 having an optical fiber 109 wrapped around a compressible cylindrical structure 121. The spool 107 can include a rigid center cylindrical portion 115, flanges 117 and an elastic compressible cylindrical structure 121 that surrounds the rigid center cylindrical portion 115. In an embodiment, the outer diameter of the compressible cylindrical structure 121 may be about 5-9 inches in diameter. However, in other embodiments, the diameter can be larger or smaller. The optical fiber 109 is wrapped around the outer diameter of the compressible cylindrical structure 121. The optical fiber 109 is wrapped at a predetermined tension around the compressible cylindrical structure 121. In an embodiment, the tension can be between about 0.001 to 1 pounds of force.

Because the spool 107 is being used in a pressurized underwater environment, the compressible cylindrical structure 121 cannot be deformed by increased water pressure. The ambient pressure is directly proportional to the depth of the ROV in the water. For example, in fresh water the pressure increase is about 0.43 pounds per square inch gage (PSIG) per foot of depth and in salt water, the pressure increase is about 0.44 PSI per foot of depth. Thus, a 100 foot dive will result in an ambient pressure of 43-44 PSIG and a 5,000 foot drive will result in an ambient pressure of 2,150-2,200 PSIG. The compressible cylindrical structure 121 must be able to retain its shape and remain compressible in very high ambient pressures. If the compressible cylindrical structure 121 is made of a material that deforms under pressure and the spool is submerged, the optical fiber 109 will become loose at a fairly shallow depth. This will cause the optical fibers 109 to be disorganized on the spool 107 and possibly tangled. As the optical fiber 109 is drawn from the spool 107, the tension will not be uniform and the optical fiber 109 will become tangled.

Figure 6:
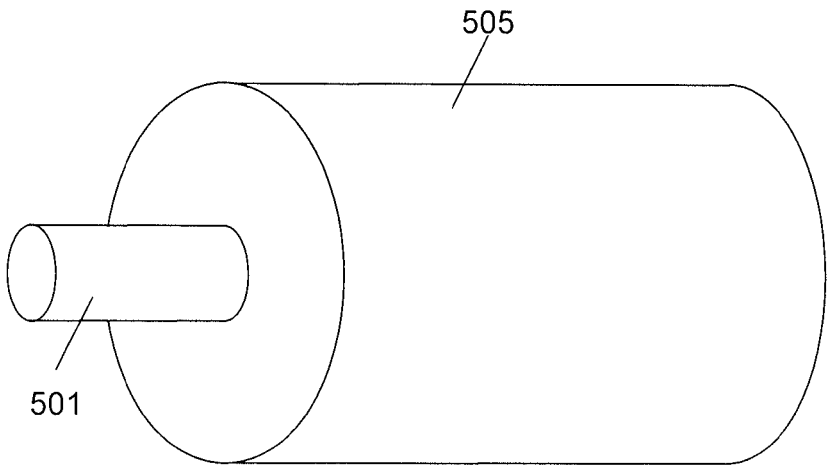
FIG. 6 illustrates an embodiment of an optical cable.

With reference to FIG. 6, in an embodiment the optical fiber can include a core 501 that is an optical transmitter and a plastic coating 505. In an embodiment, the core 501 may be about 10 μm in diameter and can be surrounded by a plastic coating 505 that has an outer diameter of about 125 μm. In other embodiments, the core can be about 5-400 μm in diameter and the coating can have a diameter of about 50-500 μm. The core can be made of glass. However, in other embodiments, the core can be made of other materials, such as fluorozirconate, fluoroaluminate, and chalcogenide glasses as well as crystalline materials like sapphire. Silica and fluoride glasses usually have refractive indices of about 1.5, but some materials such as the chalcogenides can have indices as high as 3. Typically the index difference between core 501 and plastic coating 505 is less than one percent. In other embodiments, the core 501 can be made of plastic optical fibers (POF) that may have a core diameter of 0.5 millimeters or larger.

The optical fiber 501 can have one or more coatings. The plastic coating 505 can act as a shock absorber to minimize attenuation caused by microbending. Fiber optic coatings can be applied in various different methods. In a "wet-on-dry" process, the optical fiber passes through a primary coating application, which is then UV cured. The plastic coating 505 is applied in a concentric manner to prevent damage to the fiber during the drawing application and to maximize fiber strength and micro bend resistance.

The core 501 can be surrounded by a plastic coating 505 that has an outer diameter of about 5-400 μm and in a preferred embodiment the diameter can be about 125 μm. In other embodiments, the core 501 can be in diameter and the coating 505 can have a diameter of about 50-500 μm. As discussed, the covering of optical fiber core 501 can be external soluble or biodegradable plastic coating specially engineered to meet the specific requirements of ocean deployment. The outer plastic coating 505 of raw optical fiber core 501 is changed to be a water-soluable plastic, for example a plastic containing corn starch, that would degrade in approximately say one month in sea water at close to zero degrees centigrade lying on the sea floor or slightly embedding into the sediment.

Another potential optical fiber coating 505 material is polyactic acid (PLA). PLA can be processed like most thermoplastics. Several forms of PLA exist including: poly-L-lactide (PLLA) and poly-D-lactide (PDLA) which form a highly regular stereocomplex with increased crystallinity. Biodegradation of PDLA and PLLA are slower than PLA due to the higher crystallinity.

Figure 7:
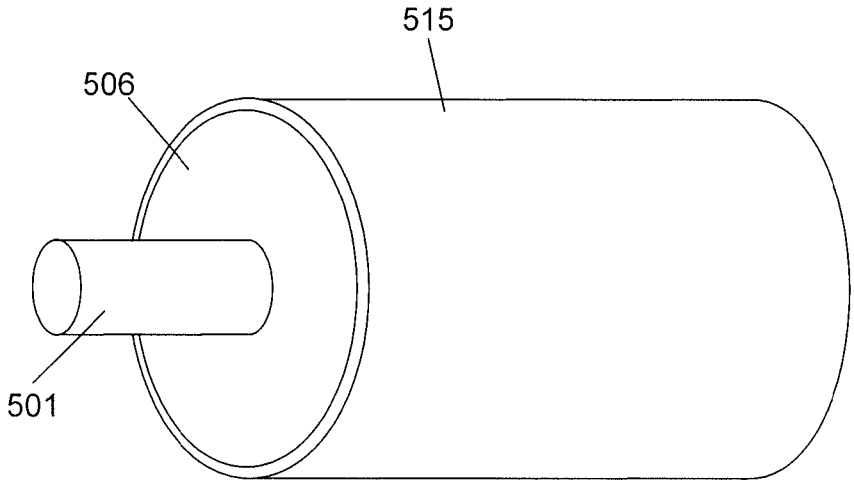
FIG. 7 illustrates an embodiment of an optical cable having a biodegradable coating and an opaque layer.

With reference to FIG. 7, in different embodiments, the optical fiber coating 506 can be transparent or opaque. In some cases, light that is transmitted through the core 501 can also be emitted through a transparent optical fiber coating 506. This illumination may be in the infrared optical region and can cause the optical fiber coating 506 to be a potential target for animals and other light sensitive creatures that might bite or damage the cable. Also, for covert/defense applications having a cable that emits any light can result in detection by sensors. In order to eliminate this potential problem, the optical fiber coating 506 can be opaque. An additive can be added to make the coating 506 opaque. In other embodiments, an additional opaque layer 515 can be applied over the coating 506 to prevent all light from being emitted by the optical fiber coating 506. The opaque layer 515 can also be biodegradable and can dissolve in water like the coating 506.

Figure 8:
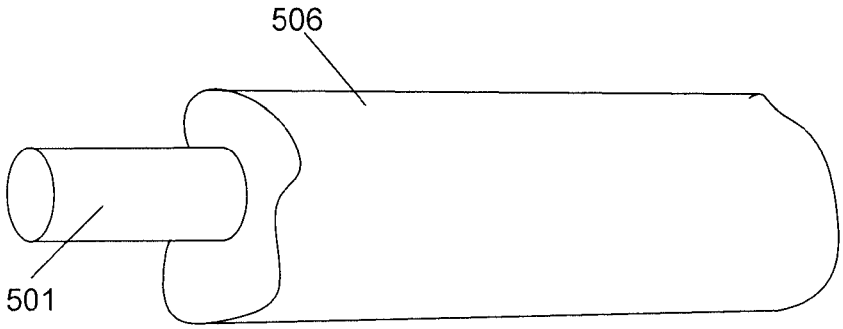
FIG. 8 illustrates an embodiment of an optical cable having a partially dissolved biodegradable coating.
Figure 9:
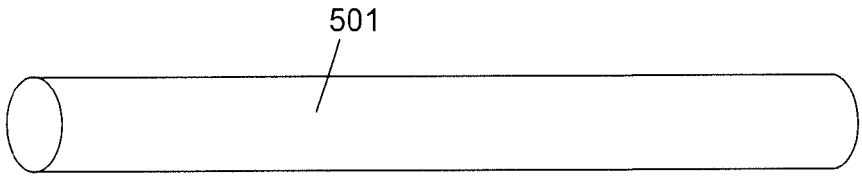
FIG. 9 illustrates an optical fiber after the coating has dissolved.
Figure 10:
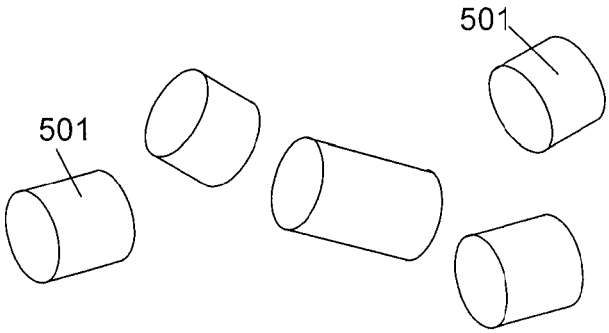
FIG. 10 illustrates the optical fiber after it has been broken into small sand pieces.

After the ROV mission is complete, the ROV may surface and be retrieved and the optical cable can be separated from the ROV and the support ship. With reference to FIG. 8, as the optical fiber cable remains in the water, the coating 506 and possibly the opaque layer 515 dissolve in the water. With reference to FIG. 9, eventually only the core 501 material is left. The co-axial glass core 501 can be substantially the same as a normal optic fiber of a single mode optical fiber cable that does not have a biodegradable covering 505. Since the core 501 is typically only 0.003 inch diameter, it will be extremely fragile without the protective coating 506. With reference to FIG. 10, any bending or physical contact can cause the optical core 501 to mechanically break down in the sediment, essentially returning to "sand". Thus, the disposed fiber composed of its plastic coating and glass core, is quickly degradable and non-polluting.

Another feature of the present invention is the ability to control the buoyancy of the optical cable. In a preferred embodiment, the density of the complete optical fiber cable is close to but slightly greater than the density of sea water. This density will slow the descent and thus minimize the risk that the optical fiber cable will contact the bottom of the sea during the duration of the mission. A neutrally buoyant optical fiber cable would give unlimited operational time since the cable will effectively float in the ambient water without the fiber contacting the sea floor. However, because of environmental concerns, it is preferred that the density be slightly higher to ensure that the fiber will fall to the bottom in a timely manner for assimilation into the sediment and biodegradation. With reference to FIG. 8, during the biodegradation process, the sea floor is also less harmful to sea life while the external coating 505 dissolves.

In another embodiment, the optical fiber cable can be designed to be neutrally buoyant for the duration of the mission but the plastic coating 505 can have a faster rate of biodegradation. For example, within 24 hours, the coating 505 can gain weight or lose volume so that after the useful life of the optical fiber cable is expended, the cable sinks and is quickly assimilated into the bottom sediments. This design further minimizes the potential for bottom contact, thus decreasing the risk of premature breakage of the optical fiber cable. In yet another embodiment, the optical fiber cable can initially have a positive buoyancy. When placed in water, the coating can absorb some of the ambient water and the weight in the water can be adjusted to be slightly negative or neutral as required by the application.

In order to change the buoyancy of the optical fiber cable, density of the coating can be changed or the relative diameters of the core and coating can be adjusted. In a preferred embodiment of this invention, the minimum changes are made to the production tooling for the fiber. Therefore, in the preferred case the glass single mode core 501 diameter and density is unchanged and remains standard. Further, the outside diameter of the plastic coating 505 is also unchanged to enable the use of standard production tooling, and the desired results are obtained only by altering the density of the outer protective soluble plastic layer.

By knowing the density and diameter of the core and the outer diameter of the coating, the required density of the coating can be determined and a suitable material can be used to fabricate the optical fiber cable. For example, an ultra light plastic such as ultra high molecular weight (UHMW) polyethylene with specific gravity 0.89 for the coating using standard production tooling will produce a fiber optic fiber that is very close to neutral buoyancy in sea water. Further, the ultra light plastic coating can be doped with a soluble component such as corn starch to further promote the solubility in water.

As a practical matter, ideal perfect neutral buoyancy can never be achieved since the density of sea water itself is variable depending on temperature, salinity and depth. Thus, there can be variations in density even within a single body of water. Therefore, in a preferred embodiment, the optical fiber cable has a slightly negative buoyancy, biasing the result to environmental safety with the disposed fiber enmeshed in bottom sediment. Therefore, the preferred embodiment will maintain existing standard fiber production diameters and the plastic coating will be designed with specific gravity slightly greater than 0.89, the preferred range being 0.9 to 0.94 after solubility modifications.

The following calculations are for a near neutrally-buoyant optical fiber cable. For single mode fiber, the glass inner and outer coaxial glass cores together may be standardized at approximately a 0.003 inch outside diameter. Therefore, volume of glass per 1,000 feet unit length is $\pi\times$(Radius)$\times$length or $\pi\times(0.003\text{ inch}/2)^2\times 12{,}000$ inches=0.0848 cubic inches. For buoyancy calculations the combined specific gravity of the two glasses (they have different refractive index and slightly different specific gravities) comprising the light transmitting single mode core may be taken as 2.7. Thus, the weight per cubic inch of glass is approximately 0.097 lbs. and the weight of 1,000 feet of 0.003 inch diameter glass is about 0.0082 lbs.

The volume of plastic per 1,000 feet of single mode fiber with standard outside diameter taken as 0.010 inch is $\pi\times$(Radius)$\times$length−volume of glass or $\pi\times(0.01\text{ inch}/2)^2\times 12{,}000$ inches−0.0848 cubic inches=0.86 cubic inches. The weight of plastic in a standard optical fiber cable per 1,000 feet assuming a specific gravity of the plastic is 1.14 or 0.041 lbs per cubic inch is 0.035 lbs. Thus, a standard optical fiber cable with both the glass core and the plastic covering can have a specific gravity higher than that of sea water. The total weight of a standard fiber per 1,000 feet is 0.0082 lbs+0.035 lbs.=0.043 lbs. The displacement volume of fiber is $\pi\times(0.01/2)^2\times 12{,}000$ cubic inches=0.94 cubic inches. The weight of the sea water displacement per 1,000 ft of standard is 0.94 cubic inch×0.037 lbs/cubic inch=0.035 lbs. Sea water has a density of 0.037 lbs per cubic inch. Therefore, as a reference, the typical negative buoyancy of a standard single mode fiber is the weight of the standard optical cable−the weight of water which is 0.043 lbs−0.035 lbs=0.008 lbs per 1,000 ft.

In a preferred embodiment, the fiber production tooling may be relatively unchanged but the plastic coating material is substituted for one having a specific gravity close to UHMW polyethylene for example (s.g. =0.89, 0.032 lbs per cu in). It can be seen that weight of the plastic per 1,000 ft of fiber is reduced to 0.027 lbs per 1,000 ft and the total weight of fiber optic with standard glass core and standard outside diameter is 0.027 lbs of plastic+0.0082 lbs of glass=0.035 lbs weight per 1,000 ft of optical fiber cable.

Since the displacement of the optical fiber is also 0.035 lbs per 1,000 ft, this fiber would be very close to neutrally buoyant with a standard 0.01 inch outer diameter plastic light weight coating having a S.G. of 0.89. However, in a preferred embodiment, considering environmental impact is to have the fiber slightly negative buoyancy so that over time the discarded fiber reaches the seabed safely but that the downward migration is slowed, minimizing fiber to seabed contact during the ROV mission which may typically last between 9 to 12 hours.

The above calculations assume that the existing optical fiber diameter and plastic cover diameter are used. In an alternative embodiment, the outer diameter of the fiber optic cable can be changed to achieve the desired results. From calculations above, the ideal specific gravity of the water soluble plastic coating around the glass core of ocean-deployable optical fiber is 0.9−0.95 with a standard outer diameter of 0.010 inches. This would lower the in-water weight from 0.008 lbs per 1,000 ft to approximately 0.0005-0.002 lbs per 1,000 ft which would reduce the theoretical downwards migration velocity using standard skin drag calculations by the square root of 10.

In other embodiments, it is possible to construct an optical fiber cable that has an outer diameter that is greater or smaller than 0.010 inch. Since the density of sea water is approximately 0.037 lb/in$^3$, the net density of the optical fiber cable should be slightly greater than 0.037 lb/in$^3$. A 5%-10% greater density can be between 0.039 lb/in$^3$ and 0.041 lb/in$^3$. Thus, an optical fiber cable having a plastic coating that has a much lower density can be thinner than 0.010 and a coating that has a higher density can have diameter that is larger than 0.010. Both optical fiber cables can have the same net density. The optical fiber cable density can be represented by the general density weight/volume equation where weight=density of the coating×volume+the core weight. By adjusting the outer diameter based upon the density of the coating material, the net density of the optical fiber cable can be adjusted to be greater than about 0.039 lb/in$^3$ and less than about 0.041 lb/in$^3$.

The lower density results in a lower downward velocity through the water due to gravity. In comparison to a standard optical fiber cable, there should be approximately three times more time for the optical fiber cable to contact the sea floor. However, due to other factors at such a small scale, standard drag calculations may be inaccurate. In-water experiments were performed on a standard optical fiber cable that was allowed to sink into the 8,000 ft deep Monterey canyon simulating a typical vehicle mission. The average survival time of standard fiber was three hours. After three hours, the optical fiber was terminated by sinking to the bottom and mechanically snagging an object on the sea floor causing optical fiber failure. Thus, from experimental results in the ocean, it is shown that slowing the downwards migration by a factor of three to four will result in an optical fiber cable survival times of at least 9 to 12 hours or more. The calculated downward migration velocity due to gravity can be reduced by a factor of three by reducing the downward gravitational force or negative buoyancy by a factor of 10 achieved as described above.

It will be understood that the inventive system has been described with reference to particular embodiments, however additions, deletions and changes could be made to these embodiments without departing from the scope of the inventive system. Although the systems that have been described include various components, it is well understood that these components and the described configuration can be modified and rearranged in various other configurations.

What is claimed is:

1. An apparatus comprising:

a spool for storing an optical fiber;

a motor for rotating the spool;

a speed transducer for detecting a rate of movement of the apparatus through the water; and a controller coupled to the motor for controlling the removal of the optical fiber from the spool at a rate that is equal to or greater than a detected rate of movement of the apparatus through the water;

wherein the spool, the motor, the speed transducer and the controller move with the apparatus at the detected rate of movement through the water.

2. The apparatus of claim 1 further comprising:

a remotely operated vehicle (ROV) coupled to the spool, the motor, the speed transducer and the controller.

3. The apparatus of claim 2 wherein the ROV is a winged submersible.

4. The apparatus of claim 1 further comprising:

an emitter that applies tension to the optical fiber that is removed from the spool.

5. The apparatus of claim 4 wherein the emitter includes a water pump that transmits the water through a tube that surrounds a portion of the optical fiber.

6. The apparatus of claim 1 further comprising:

a rotational coupling attached to an end of the optical fiber.

7. The apparatus of claim 1 wherein the spool includes:

a cylindrical section having a plurality of water flow holes;

a first flange coupled to one end of the cylindrical section;

a second flange coupled to a second end of the cylindrical section; and a compressible cylinder surrounding the cylindrical section, the compressible cylinder having an open volume.

8. The apparatus of claim 1 wherein the optical fiber is biodegradable.

9. An apparatus comprising:

a spool for storing an optical fiber;

a motor for rotating the spool;

a receiver coupled to the optical fiber for receiving apparatus velocity signals; and a controller coupled to the motor for controlling the removal of the optical fiber from the spool at a rate that is equal to or greater than the apparatus velocity signals;

wherein the spool, the motor, the receiver and the controller move with the apparatus at the detected rate of movement through a body of water.

10. The apparatus of claim 9 further comprising:

a remotely operated vehicle (ROV) coupled to the spool, the motor and the controller.

11. The apparatus of claim 10 wherein the ROV is a winged submersible.

12. The apparatus of claim 9 further comprising:

an emitter that applies tension to the optical fiber that is removed from the spool.

13. The apparatus of claim 12 wherein the emitter includes a water pump that transmits the water through a tube that surrounds a portion of the optical fiber.

14. The apparatus of claim 9 further comprising:

a rotational coupling attached to an end of the optical fiber.

15. The apparatus of claim 9 wherein the spool includes:

a cylindrical section having a plurality of water flow holes;

a first flange coupled to one end of the cylindrical section;

a second flange coupled to a second end of the cylindrical section; and a compressible cylinder surrounding the cylindrical section, the compressible cylinder having an open volume.

16. The apparatus of claim 9 wherein the optical fiber is biodegradable.

17. A method comprising:

detecting a movement of a remotely operated vehicle (ROV) with a speed transducer;

transmitting a speed signal from the speed transducer to a motor;

rotating a spool storing an optical fiber with the motor at a rate that is equal to or greater than a rate of movement of the ROV;

removing the optical fiber from the spool and the ROV; and transmitting control signals through the optical fiber on the spool on the ROV.

18. The method of claim 17 further comprising:

placing the optical fiber through a tube; and pumping water through the tube at a velocity greater than the rate of movement of the ROV.

19. The method of claim 18 further comprising:

maintaining a tension force on a portion of the optical fiber between the spool and the tube.

20. The method of claim 19 wherein a tension force on a portion of the optical fiber is less than 2 ounces.

* * * * *